US010106976B2

(12) United States Patent
Viargues et al.

(10) Patent No.: US 10,106,976 B2
(45) Date of Patent: Oct. 23, 2018

(54) METHOD FOR PRODUCING A REINFORCED STRUCTURE IN THE GROUND

(71) Applicant: SOLETANCHE FREYSSINET, Rueil Malmaison (FR)

(72) Inventors: Daniel Viargues, Rueil Malmaison (FR); Christophe Guillon, Rueil Malmaison (FR)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 445 days.

(21) Appl. No.: 14/430,611

(22) PCT Filed: Sep. 26, 2013

(86) PCT No.: PCT/FR2013/052276

§ 371 (c)(1),
(2) Date: Mar. 24, 2015

(87) PCT Pub. No.: WO2014/049278

PCT Pub. Date: Apr. 3, 2014

(65) Prior Publication Data

US 2015/0225941 A1 Aug. 13, 2015

(30) Foreign Application Priority Data

Sep. 27, 2012 (FR) ..... 12 59136

(51) Int. Cl.

| | |
|---|---|
| ***E04B 1/41*** | (2006.01) |
| ***E02D 5/38*** | (2006.01) |
| ***E02D 7/18*** | (2006.01) |

(52) U.S. Cl.
CPC ..... *E04B 1/4157* (2013.01); *E02D 5/385* (2013.01); *E02D 7/18* (2013.01)

(58) Field of Classification Search
CPC . E21B 7/24; E21B 28/00; E02D 5/385; E02D 7/18; E04B 1/4157
See application file for complete search history.

(56) References Cited

U.S. PATENT DOCUMENTS 2,403,643 A * 7/1946 Dresser ..... E02D 3/12 405/267
3,557,875 A * 1/1971 Solum ..... E21B 28/00 166/177.4

(Continued)

FOREIGN PATENT DOCUMENTS

EP 2246482 A1 11/2010
FR 2502208 A1 * 9/1982 ..... E02D 5/808

(Continued)

*Primary Examiner* — Daniel P Stephenson
(74) *Attorney, Agent, or Firm* — MH2 Technology Law Group, LLP

(57) ABSTRACT

Various methods of making a reinforced structure in the ground using a boring tool are provided. One of the methods includes providing a boring tool having a boring tube that can vibrate. The method also includes making a borehole in the ground using the boring tool while causing the boring tube to vibrate. Additionally, the method includes, when the boring tube has reached a predetermined depth, injecting a sealing grout into the boring tube that embeds the boring tube in the sealing grout. Further, the method includes detaching the boring tube from the boring tool, thereby providing a structure reinforced by the boring tube.

11 Claims, 3 Drawing Sheets

(56) References Cited

U.S. PATENT DOCUMENTS

| | | | | | |
|---|---|---|---|---|---|
| 4,732,510 | A * | 3/1988 | Louis | E02D 5/62 | 405/232 |
| 4,832,535 | A * | 5/1989 | Crambes | E02D 3/08 | 405/117 |
| 7,270,182 | B2 * | 9/2007 | Johnson, Jr. | E21B 7/24 | 165/45 |
| 2003/0221870 | A1 * | 12/2003 | Johnson, Jr. | E21B 7/20 | 175/71 |
| 2004/0007387 | A1 * | 1/2004 | Bar-Cohen | E21B 7/24 | 175/50 |
| 2004/0115011 | A1 * | 6/2004 | Fox | E02D 3/08 | 405/267 |
| 2004/0120771 | A1 * | 6/2004 | Vinegar | B01D 53/002 | 405/128.4 |
| 2004/0247397 | A1 * | 12/2004 | Fox | E02D 5/46 | 405/248 |
| 2007/0031195 | A1 * | 2/2007 | Canteri | E02D 3/12 | 405/240 |
| 2007/0286687 | A1 * | 12/2007 | Melegari | E02D 5/30 | 405/239 |
| 2010/0040419 | A1 * | 2/2010 | Roussy | E21B 7/24 | 405/244 |
| 2014/0369766 | A1 * | 12/2014 | Denker | E02D 27/52 | 405/228 |
| 2015/0225941 | A1 * | 8/2015 | Viargues | E02D 5/385 | 52/745.21 |
| 2016/0010305 | A1 * | 1/2016 | Barrett | E02D 5/56 | 403/300 |

FOREIGN PATENT DOCUMENTS

| | | | | |
|---|---|---|---|---|
| FR | 2995917 | A1 * | 3/2014 | E02D 5/385 |
| KR | 101489387 | B1 * | 2/2015 | |

* cited by examiner

METHOD FOR PRODUCING A REINFORCED STRUCTURE IN THE GROUND

BACKGROUND OF THE INVENTION

The present invention relates to the field of reinforcing ground.

The invention relates more precisely to a method of making a reinforced structure in ground, such as, for example: a pile, a micropile, or indeed a reinforced structure for an umbrella vault.

Generally, making a pile comprises a step of making a borehole, a step of introducing a reinforcing element into the borehole, and a step of putting a sealing grout into place, at the end of which a pile type reinforced structure is obtained.

Although that traditional method of fabricating a reinforced structure gives entire satisfaction, it is relatively lengthy to perform because it requires different tooling for making the borehole, for introducing the reinforcing element, and for concreting, as a function of the terrains in presence and of the technique used.

OBJECT AND SUMMARY OF THE INVENTION

An object of the present invention is to propose a method of making a reinforced structure in ground that is faster than traditional methods.

The invention achieves this object by the fact that the method of the invention comprises the following steps:

- providing a boring tool comprising a boring tube having a distal end that carries a cutter member and means for causing the boring tube to vibrate;
- making a borehole in the ground with the help of the boring tool while causing the boring tube to vibrate, the boring tube being taken to a predetermined depth;
- when the boring tube has reached the predetermined depth, injecting a sealing grout into the boring tube in order to embed the boring tube in the sealing grout; and then
- detaching the boring tube from the boring tool, thereby obtaining a reinforced structure provided with a reinforcing element constituted by the boring tube.

Thus, in the invention, the boring tube is detached and left in the borehole in order to constitute the reinforcing element of the reinforced structure.

It can thus be understood that in the invention the boring tube serves both as boring means, as a guide duct for pumping the sealing grout in the borehole, and as the reinforcing element for the reinforced structure. The distal end of the boring tube preferably presents at least one perforation, and the boring fluid is injected into the boring tube so that the boring tube also acts as a guide duct for pumping the boring fluid in the borehole.

Thus, by means of the invention, the steps of injecting boring fluid and sealing grout into the borehole, and of introducing the reinforcing element are performed more quickly than in the traditional method.

In addition, making the borehole while causing the boring tube and thus the boring member to vibrate serves to facilitate penetration of the boring tool into the ground, thereby further improving the speed at which the reinforced structure is installed in the ground. During boring, the boring tube is preferably also rotated so as to change the positions of cutting teeth arranged at the distal end of the boring tube.

Advantageously, the vibration frequency applied to the boring tube lies in the range 50 hertz (Hz) to 200 Hz.

The diameter of the cutter member is preferably greater than the diameter of the boring tube, thereby making it possible to ensure that the sealing grout coats the boring tube correctly.

The term "distal" end is used to mean the end of the boring tube that is remote from the means for driving the boring tube in rotation. The term "proximal" end is thus used for the other end, which is situated close to the means for driving the boring tube in rotation.

In order to enable the boring fluid and the sealing grout to flow in the borehole, it can be understood that the distal end of the boring tube presents at least one perforation. In preferred manner, the boring member has an annular periphery provided with cutter teeth and preferably carries a diametral cutter element. The term "cutter teeth" is used to mean boring tools in general, such as tungsten carbide pellets, buttons, spikes, etc. The diametral cutter element serves to increase the area of interaction between the cutter element and the terrain, so that the cutter element can perform boring over an area that is greater than the area of the cutter member. Consequently, the efficiency of the method is further increased.

The diametral cutter element may be understood as meaning that the cutter tool is a "full face" tool having at least one perforation.

Advantageously, boring fluid is injected into the boring tube while the borehole is being made.

In preferred manner, the sealing grout is used as boring fluid.

In a variant, additional reinforcing equipment is also introduced into the boring tool, e.g. a metal bar. This additional reinforcing equipment may for example be introduced after the boring step and immediately prior to injecting the sealing grout.

Advantageously, while injecting the sealing grout, the boring tube is caused to vibrate, preferably without being driven in rotation. The term "sealing grout" is used to mean any sealing substance based on cement, slurry, or any other binder.

This vibration serves to facilitate the flow of the sealing grout in the borehole, thereby having the consequence of further improving the speed at which the method of the invention is executed and also the quality of the sealing of the reinforcement in the ground.

In preferred manner, centering means are fastened to the boring tube in order to ensure that the reinforcing element is substantially centered in the borehole while the sealing grout is being injected, so as to guarantee that the reinforcing element is well coated by the sealing grout.

It can be understood that these centering means together with the cutter member serve to guarantee that the reinforcing element is properly coated in sealing grout.

In a variant, the direction of the borehole is inclined relative to a vertical direction.

The method makes it possible in particular to make horizontal boreholes.

Preferably, the direction of the borehole is inclined relative to the vertical direction by an angle that is strictly greater than 90°. An advantage is to be able to make rising reinforced structures.

In an advantageous implementation, a target vibration frequency is calculated and the boring tube is caused to vibrate at said target vibration frequency while making the borehole.

This target vibration frequency, which is applied to the boring tube, is selected in optimum manner in order to facilitate the boring operation, specifically in ground that is particularly hard. In general, the calculation is performed on the basis of a model of perforation phenomena.

Advantageously, the calculation makes use of the length of the boring tube. Preferably, the target vibration frequency is a function of the length of the boring tube, while also being limited by a predetermined maximum frequency value, which preferably corresponds to the maximum frequency that can be developed by the means for causing the boring tube to vibrate. This predetermined maximum frequency value preferably lies in the range 100 Hz to 160 Hz. Also preferably, the calculation makes use of a constant value corresponding to the propagation speed of compression waves in the boring tube, where this speed depends on the material from which the boring tube is made.

In preferred but non-essential manner, the reference target vibration frequency is equal to:

Fmax (the predetermined maximum frequency value) if Fmax<(V)/(2*L), where V is the propagation speed of compression waves in the boring tube and L is the length of the boring tube; or (n*V)/(2*L) if Fmax>(V)/(2*L), where n is an integer greater than or equal to 1 selected so that (n*V)/(2*L) <=Fmax and ((n+1)*V)/(2*L)>Fmax.

The inventors have found that this formula makes it possible to obtain an optimum target vibration frequency that significantly increases the effectiveness of the boring operation.

This calculation is performed by a computer having appropriate calculation means.

In order to make deep boreholes, the length of the boring tube is increased while the borehole is being made. For this purpose, use is made of tube portions that are fastened together end to end during boring so as to increase the length of the borehole. Consequently, in the meaning of the invention, the term "boring tube" is used to cover equally well a single boring tube or a plurality of tubular elements fastened end to end, e.g. by screw fastening.

In advantageous manner, the target vibration frequency is recalculated each time the length of the boring tube is increased.

An advantage is to perform boring with optimum efficiency over the entire length of the borehole.

In a first implementation, the method of the invention is performed to make a micropile.

In a second implementation, the method of the invention is performed to make an umbrella vault.

BRIEF DESCRIPTION OF THE DRAWINGS

The invention can be better understood on reading the following description of embodiments of the invention given as non-limiting examples and with reference to the accompanying drawings, in which.

DETAILED DESCRIPTION OF THE INVENTION

Figure 1A:
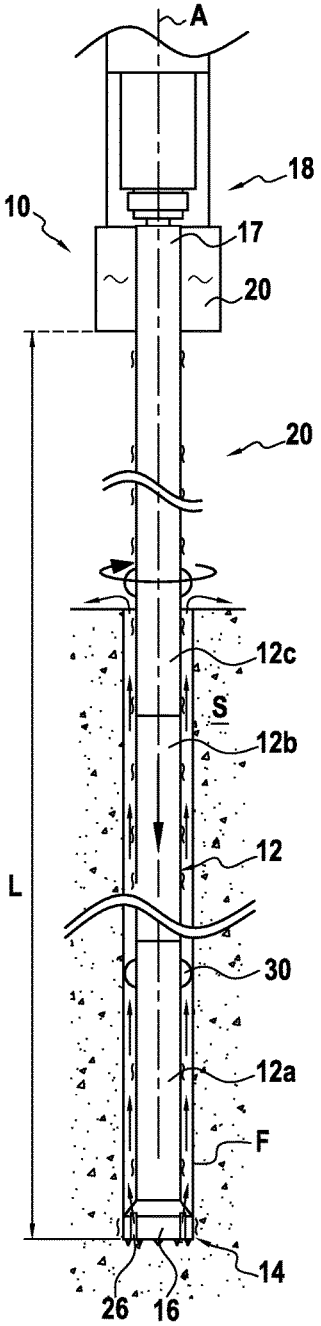
FIG. 1A shows the boring step of the method of the invention.
Figure 1B:
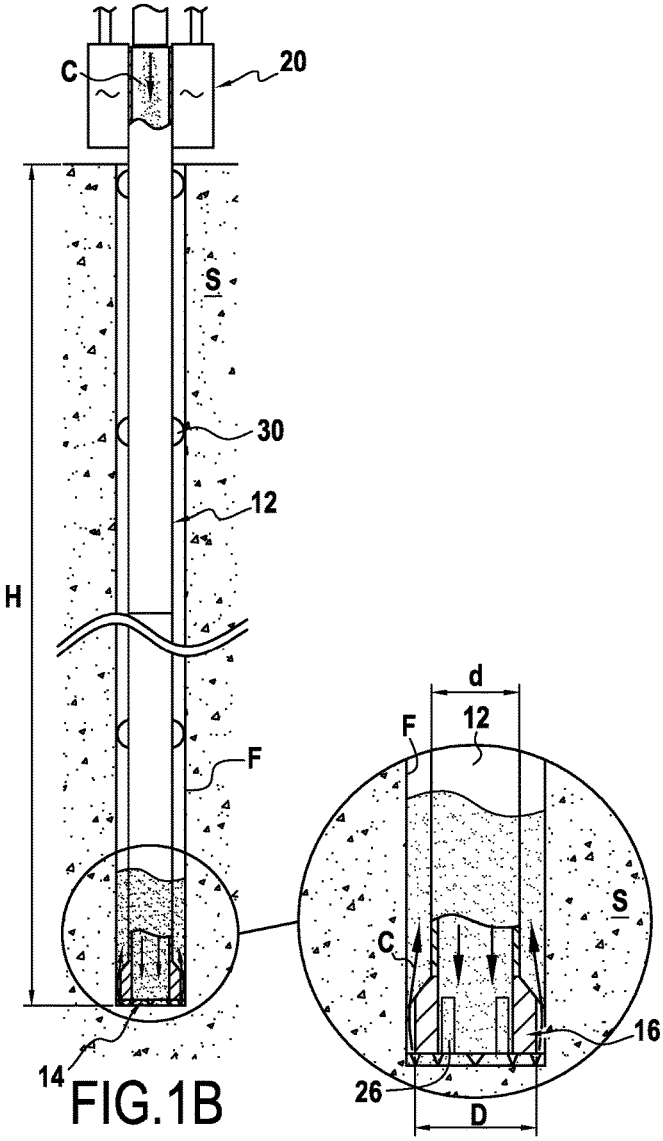
FIG. 1B shows the step of injecting a sealing grout into the boring tube.
Figure 1C:
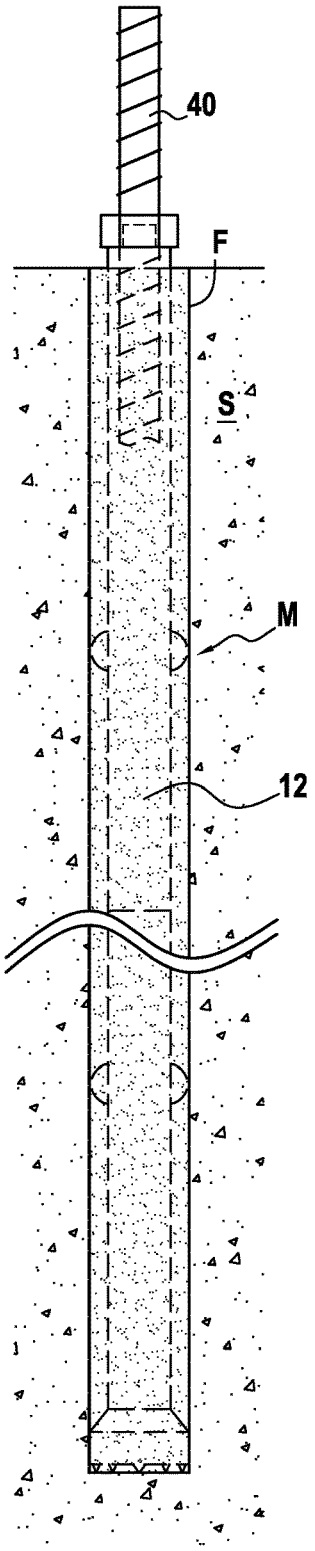
FIG. 1C is a longitudinal section view of a micropile obtained by performing the method of the invention.
Figure 3:
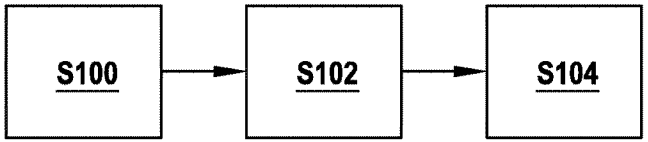
FIG. 3 is a diagram showing the method of optimizing the vibration frequency applied to the boring tube.

With reference to FIGS. 1A to 1C, there follows a description of a first implementation of the method of the invention in which a reinforced structure is made in ground S, said reinforced structure in this example being a micropile M.

In accordance with the method of the invention, a boring tool 10 is provided that comprises a boring tube 12 made up of a plurality of tubular elements 12*a*, 12*b*, 12*c*, . . . . These tubular elements are fastened together end to end so as to constitute the boring tube 12.

It can thus be understood that the length L of the boring tube 12 varies while making the borehole. More particularly, while making the borehole, as the boring tool penetrates further into the ground, new tubular elements are added to those already inserted into the ground in order to increase the length L of the boring tube 12.

The boring tube 12 has a distal end 14. In the example of FIG. 1A, the boring direction is vertically downwards, such that the distal end in this example corresponds to the bottom end of the boring tube. The distal end carries a cutter member 16. As can be seen in FIG. 1A, the diameter D of the cutter member is preferably greater than the diameter d of the boring tube 12.

In this example, the cutter member 16 is a fitting that is mounted on the distal end 14 of the boring tube 12.

The boring tube 12 also has a proximal end 17 that is connected in this example to means 18 for driving the boring tube 12 in rotation and to means 20 for causing the boring tube 12 to vibrate.

In this example, the means 18 for driving the boring tube 12 in rotation comprise a hydraulic motor.

The means 20 for causing the boring tube to vibrate, specifically a vibration generator 20, serve to generate compression waves that are transmitted along the boring tube 12 from the proximal end 17 towards the distal end 14.

In FIG. 1A, reference L designates the length of the boring tube 12. This length corresponds specifically to the distance between the means 20 for causing the boring tube 12 to vibrate and the distal end 14 of the boring tube 12, which distance corresponds essentially to the distance between the distal and proximal ends of the boring tube.

In accordance with the invention, a borehole F is made in the ground S using the boring tool 10 by causing the boring tube to rotate about the vertical axis A by using the rotary drive means 18 and by causing it to vibrate by using the means 20 for causing the boring tube 12 to vibrate.

While making the borehole, a boring fluid is injected into the boring tube so as to evacuate the debris excavated by the cutter member 16. As can be seen in FIG. 1A, the cutter member 16 has perforations 26 through which the boring fluid flows out from the boring tube prior to rising to the surface while flowing between the boring tube and the wall of the borehole F.

Thereafter, as shown in FIG. 1B, when the boring tube 12 has reached the predetermined depth H, a sealing grout C is injected into the boring tube. This is a cement grout. The fact that the diameter D of the cutter member 16 is greater than the diameter d of the boring tube enables the boring tube to be substantially centered at its distal end 16. Furthermore, as can be seen in FIG. 1B, the boring tube 12 is provided with centering means 30 that are fastened along the boring tube 12.

These centering means 30 serve in particular to center the boring tube 12 at the foot of the borehole F while the sealing grout is being injected so as to ensure that the boring tube is coated by the sealing grout. The centering means 30 are thus arranged to avoid the wall of the boring tube coming into contact with the terrain. In this example, the centering means 30 are in the form of fins that are fastened to the outside wall of the boring tube 12. The sealing grout C flows through the perforations 26 so that the boring tube 12 becomes embedded in the sealing grout C.

In this example, while the sealing grout C is being injected, the boring tube 12 is caused to vibrate without being driven in rotation, thereby enhancing the flow of the sealing grout in the borehole F.

After the sealing grout has been injected, the boring tube is adjusted to its final position, which is generally a little higher than the bored depth, and it is held in this position, with the boring tube 12 being detached from the boring tool 10. In other words, the boring tube 12 is left in the borehole filled with the sealing grout.

In this example, before the sealing grout has set completely, fastener equipment 40, e.g. a short metal bar, is added to the top end of the borehole F, thereby obtaining a reinforced structure in the form of a micropile M having a reinforcing element that is constituted by the boring tool 12.

Figure 2:
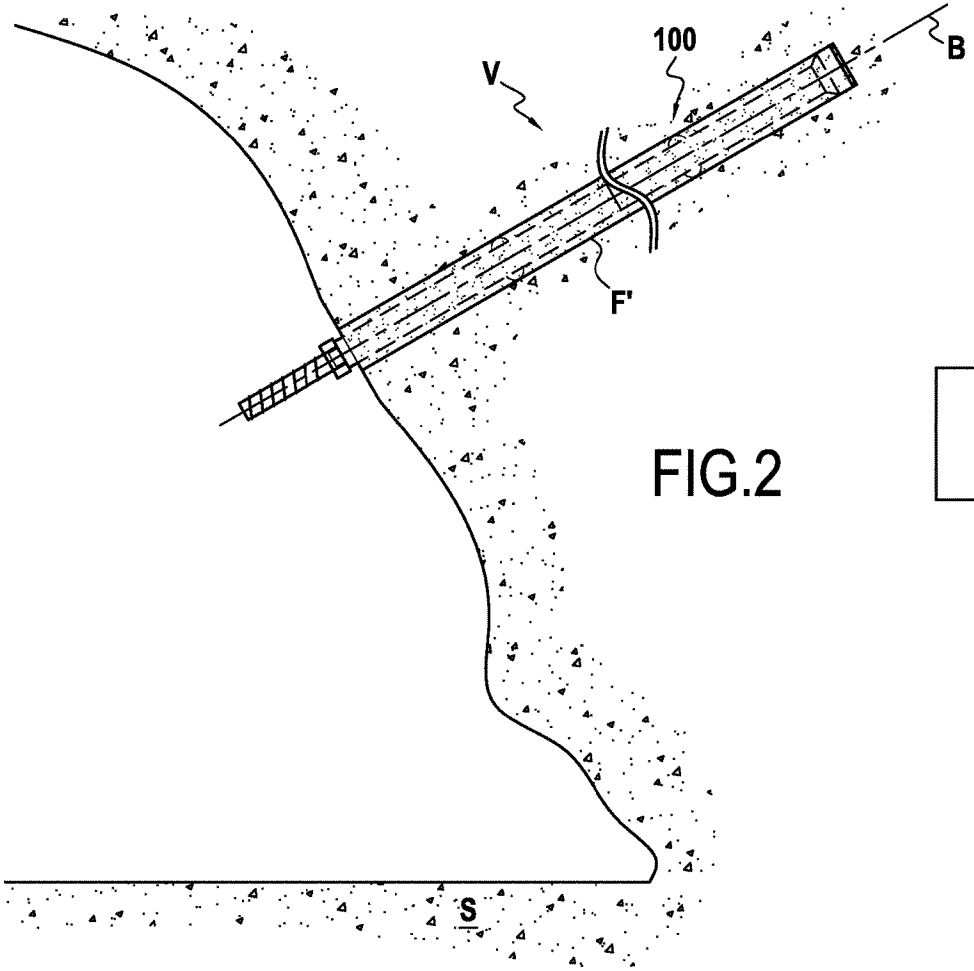
FIG. 2 is a longitudinal section view of a reinforced structure of an umbrella vault obtained by performing the method of the invention.

FIG. 2 shows a reinforced structure 100 that is obtained by performing the method of the invention, in which the boring direction F' is inclined relative to the vertical direction at an angle that is strictly greater than 90°. In this example, an umbrella vault V is fabricated that is constituted by a plurality of rising reinforced structures 100.

In a particularly advantageous aspect of the invention, while making the boreholes F and F' as described above, it is desired to optimize the vibration frequency so as to maximize the boring energy that is transmitted by the boring tube 12. For this purpose, a target vibration frequency is calculated for application to the boring tube 12 by the vibration generator.

The boring tube 12 is thus caused to vibrate at the target vibration frequency while making the various boreholes F, F'. It can thus be understood that this target vibration frequency is a vibration frequency that is applied to the boring tube. Specifically, the vibration comprises compression waves that travel along the boring tube defining nodes and antinodes. These vibration waves cause the boring tube 12 to enter into resonance, or at least they are at a frequency close to its resonant frequency, thereby maximizing energy on the cutter member 16, with the effect of significantly increasing the efficiency of boring, and thus the overall efficiency of the method of the invention.

Calculating the target vibration frequency begins with a step S100 during which the length L of the boring tube 12 is input manually or is determined automatically. It is assumed in this example that the boring tube is set into vibration over its entire length.

Thereafter, on the basis of this length, the target vibration frequency is calculated during a step S102 on the basis of the length L of the boring tube, and of the propagation speed of the compression wave in the boring tube 12, which in this example is made of steel.

Also preferably, the calculation makes use of a constant value that corresponds to the propagation speed of compression waves in the boring tube, which speed depends on the material from which the boring tube is made.

In accordance with the invention, insofar as the length of the boring tube 12 increases while the borehole is being made because successive tubular elements 12*a*, 12*b*, . . . , are added, the target vibration frequency is recalculated each time the length of the boring tube is increased. This makes it possible to conserve an optimum vibration frequency throughout the duration of boring.

The target vibration frequency calculated in this way is then displayed as a suggestion to the operator. In another implementation it may also be set as a setpoint to the vibration generator 20 during a step S104.

In a manner that is preferred but not essential, the reference target frequency is equal to:

Fmax (the predetermined maximum frequency value) if Fmax<(V)/(2*L), where V is the propagation speed of compression waves in the boring tube and L is the length of the boring tube; or (n*V)/(2*L) if Fmax>(V)/(2*L), where n is an integer greater than or equal to 1 selected so that (n*V)/(2*L) <=Fmax and ((n+1)*V)/(2*L)>Fmax.

In the example below, V is equal to 5000 meters per second (m/s), and Fmax is equal to 130 Hz.

L, the length of the borehole, is equal to the sum of the lengths of the tubular elements 12*a*, 12*b*, 12*c*, . . . . In this example, the tubular elements have the same unit length, namely a length of 3 m.

The following table of results is obtained:

| No. of tubes | L (m) | 2L | V/(2*L) | n | Target F (Hz) |
|---|---|---|---|---|---|
| 5 | 15 | 30 | 167 | | 130 (Fmax) |
| 6 | 18 | 36 | 139 | | 130 (Fmax) |
| 7 | 21 | 42 | 119 | 1 | 119 |
| 8 | 24 | 48 | 104 | 1 | 104 |
| 9 | 27 | 54 | 93 | 1 | 93 |
| 10 | 30 | 60 | 83 | 1 | 83 |
| 11 | 33 | 66 | 76 | 1 | 76 |
| 12 | 36 | 72 | 69 | 1 | 69 |
| 13 | 39 | 78 | 64 | 2 | 128 |
| 14 | 42 | 84 | 60 | 2 | 120 |
| 15 | 45 | 90 | 56 | 2 | 112 |
| 16 | 48 | 96 | 52 | 2 | 104 |
| 17 | 51 | 102 | 49 | 2 | 98 |
| 18 | 54 | 108 | 46 | 2 | 93 |
| 19 | 57 | 114 | 44 | 2 | 88 |
| 20 | 60 | 120 | 42 | 3 | 126 |
| 21 | 63 | 126 | 40 | 3 | 120 |
| 22 | 66 | 132 | 38 | 3 | 114 |
| 23 | 69 | 138 | 36 | 3 | 108 |
| 24 | 72 | 144 | 35 | 3 | 105 |
| 25 | 75 | 150 | 33 | 3 | 99 |
| 26 | 78 | 156 | 32 | 4 | 128 |
| 27 | 81 | 162 | 31 | 4 | 124 |

The invention claimed is:

1. A method of making a reinforced structure in ground, said method comprising:

calculating a target vibration frequency;

providing a boring tool comprising a boring tube having a distal end that carries a cutter member and a vibrating device configured to vibrate the boring tube;

making a borehole in the ground using the boring tool, wherein:

making the borehole comprises vibrating the boring tube at the target vibration frequency, and boring the boring tube to a predetermined depth, the length of the boring tube is increased while the borehole is made, and the target vibration frequency is recalculated each time the length of the boring tube is increased;

when the boring tube has reached the predetermined depth, injecting a sealing grout into the boring tube in order to embed the boring tube in the sealing grout; and after embedding the boring tube, detaching the boring tube from the boring tool, thereby obtaining a reinforced structure provided with a reinforcing element constituted by the boring tube.

2. The method according to claim 1, wherein the diameter of the cutter member is greater than the diameter of the boring tube.

3. The method according to claim 1, wherein, while injecting the sealing grout, the boring tube is caused to vibrate.

4. The method according to claim 1, wherein a centering device is fastened to the boring tube in order to ensure that the reinforcing element is centered in the borehole while the sealing grout is being injected.

5. The method according to claim 1, wherein the direction of the borehole is inclined relative to a vertical direction.

6. The method according to claim 5, wherein the direction of the borehole is inclined relative to the vertical direction by an angle that is strictly greater than 90°.

7. A method of fabricating a micropile, wherein the steps of the method according to claim 1 are performed.

8. A method of fabricating an umbrella vault, wherein the steps of the method according to claim 1 are performed.

9. A method of making a reinforced structure in ground, said method comprising:

providing a boring tool comprising a boring tube having a distal end that carries a cutter member and a vibrating device configured to vibrate the boring tube;

calculating a target vibration frequency using a length of the boring tube, a propagation speed of compression waves in the boring tube, and a predetermined maximum frequency value;

making a borehole in the ground to a predetermined depth using the boring tool while vibrating the boring tube;

when the boring tube has reached the predetermined depth, injecting a sealing grout into the boring tube in order to embed the boring tube in the sealing grout; and after embedding the boring tube, detaching the boring tube from the boring tool, thereby obtaining a reinforced structure provided with a reinforcing element constituted by the boring tube.

10. A method of making a reinforced structure in ground, said method comprising:

providing a boring tool comprising a boring tube having a distal end that carries a cutter member and a vibrating device configured to vibrate the boring tube;

calculating a target vibration frequency equal to:

Fmax, named the predetermined maximum frequency value, if Fmax<(V)/(2*L), where V is the propagation speed of compression waves in the boring tube and L is the length of the boring tube; or (n*V)/(2*L) if Fmax>(V)/(2*L), where n is an integer greater than or equal to 1 selected so that (n*V)/(2*L)<=Fmax and ((n+1)*V)/(2*L)>Fmax;

making a borehole in the ground to a predetermined depth using the boring tool while causing the boring tube to vibrate at the target vibration frequency;

when the boring tube has reached the predetermined depth, injecting sealing grout into the boring tube in order to embed the boring tube in the sealing grout; and after embedding the boring tube, detaching the boring tube from the boring tool, thereby obtaining a reinforced structure provided with a reinforcing element constituted by the boring tube.

11. A method of making a borehole using a boring tool, the boring tool comprising a boring tube, a distal end, and a vibrating device configured to vibrate the boring tube at more than one frequency, wherein making the borehole comprises:

determining a first vibration frequency based on an initial length of the boring tube;

drilling the boring tube into ground while vibrating the boring tube at the first vibration frequency using the vibrating device;

increasing the length of the boring tube to a second length;

determining a second vibration frequency based on the second length of the boring tube;

drilling the boring tube into ground while vibrating the boring tube at the second vibration frequency using the first vibrating device;

at a predetermined depth, embed the boring tube in the borehole by injecting sealing grout into the borehole from the distal end of the boring tool; and detaching the boring tube from the boring tool after embedding the boring tube in the borehole.

* * * * *